US009297146B1

(12) United States Patent
Wei et al.

(10) Patent No.: US 9,297,146 B1
(45) Date of Patent: Mar. 29, 2016

(54) AUTOMATIC RIPPING PASS DETECTION

(71) Applicant: Caterpillar Inc., Peoria, IL (US)

(72) Inventors: Mo Wei, Dunlap, IL (US); Thandava Krishna Edara, Peoria, IL (US); Michael Allen Taylor, Swissvale, PA (US); Troy Kenneth Becicka, Sahuarita, AZ (US); Seth J. Rodenbo, Metamora, IL (US); Matthew E. Kontz, Chillicothe, IL (US); Kenneth L. Stratton, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/481,655

(22) Filed: Sep. 9, 2014

(51) Int. Cl.
*E02F 9/20* (2006.01)
*E02F 5/32* (2006.01)

(52) U.S. Cl.
CPC ..... *E02F 9/2025* (2013.01); *E02F 5/32* (2013.01)

(58) Field of Classification Search
CPC ..... E02F 9/2025; E02F 5/32
USPC ..... 701/50
See application file for complete search history.

(56) References Cited

U.S. PATENT DOCUMENTS

| | | | | |
|---|---|---|---|---|
| 4,031,964 | A | 6/1977 | Takahashi et al. | |
| 4,044,838 | A | 8/1977 | Wooldridge | |
| 7,658,234 | B2 | 2/2010 | Brandt et al. | |
| 8,083,004 | B2 | 12/2011 | Knight, Jr. | |
| 8,616,297 | B2 | 12/2013 | Shintani et al. | |
| 2008/0243345 | A1 * | 10/2008 | Knight | 701/50 |
| 2014/0277957 | A1 * | 9/2014 | Clar et al. | 701/50 |

* cited by examiner

*Primary Examiner* — Rodney Butler
*Assistant Examiner* — Anne Mazzara
(74) *Attorney, Agent, or Firm* — Finnegan, Henderson, Farabow, Garrett & Dunner, LLP

(57) ABSTRACT

A computer-implemented method for automatically detecting a need for a ripping pass to be performed by a machine along a work surface is provided. The method may include monitoring one or more of machine parameters of the machine and profile parameters of the work surface, determining whether one or more predefined trigger conditions suggestive of the need for the ripping pass are met based on the machine parameters and the profile parameters, and generating a ripping pass request if one or more of the trigger conditions are satisfied.

20 Claims, 5 Drawing Sheets

AUTOMATIC RIPPING PASS DETECTION

TECHNICAL FIELD

The present disclosure relates generally to operating autonomous machines at a work site, and more particularly, to systems and methods for automatically detecting ripping pass locations based on predefined conditionals.

BACKGROUND

Machines such as, for example, track-type tractors, dozers, motor graders, wheel loaders, and the like, are used to perform a variety of tasks. For example, these machines may be used to move material and/or alter work surfaces at a worksite. The machines may be manned machines, but may also be semi-autonomous or autonomous vehicles that perform these tasks in response to commands remotely or locally generated as part of a work plan for the machines. Moreover, the machines may receive instructions in accordance with the work plan to at least partially autonomously perform repetitive and relatively localized operations such as cutting, digging, loosening, loading, carrying, and any other manipulation of materials at the worksite.

Among other things, autonomous machines, such as dozers, are frequently used to perform normal cuts along a work surface and in accordance with predetermined pass or cut profiles. While performing cuts, however, these machines often encounter sections of hard material which cannot be cut or removed using the normal cut routines and blade implements. Such hard sections cause unwanted interruptions and hinder overall productivity. If left unattended, for instance, these hard sections may leave undesirable raised surfaces in the terrain that become more pronounced with every pass, or cause other deviations from the planned course or target profile. Thus, it is typical for operators to manually intervene and engage a ripping pass for every 3 to 10 normal cuts so as to loosen the terrain and avoid profile deviations caused by hard sections.

With the frequency to which such ripping passes are performed per work site and the frequency to which manual operator involvement is required by conventional systems, there is a need to provide a more intuitive automated scheme to minimize operator involvement as well as to improve overall efficiency. Some conventional systems may provide partial automated ripper control, such as disclosed in U.S. Pat. No. 8,616,297 ("Shintani, et al."). While automated ripper control may help reduce operator involvement, there is still substantial room for improvement. The system in Shintani, et al., for instance, still requires manual intervention by the operator to not only identify hard sections in a given terrain, but also to initiate the automated ripping sequence.

In view of the foregoing inefficiencies and disadvantages associated with conventional autonomous machines and control systems therefor, a need exists for more intuitive automatic control systems which minimize operator involvement and improve overall efficiency and productivity.

SUMMARY OF THE DISCLOSURE

In one aspect of the present disclosure, a computer-implemented method for automatically detecting a need for a ripping pass to be performed by a machine along a work surface is provided. The method may include monitoring one or more of machine parameters of the machine and profile parameters of the work surface, determining whether one or more predefined trigger conditions suggestive of the need for the ripping pass are met based on the machine parameters and the profile parameters, and generating a ripping pass request if one or more of the trigger conditions are satisfied.

In another aspect of the present disclosure, a control system for automatically detecting a need for a ripping pass to be performed by a machine along a work surface is provided. The control system may include a memory configured to retrievably store one or more algorithms, and a controller in communication with the memory. Based on the one or more algorithms, the controller may be configured to at least monitor one or more of machine parameters of the machine and profile parameters of the work surface relative to one or more predefined trigger conditions suggestive of the need for the ripping pass, and generate a ripping pass request if at least one of the machine parameters and the profile parameters meet one or more of the trigger conditions.

In yet another aspect of the present disclosure, a controller for automatically detecting a need for a ripping pass to be performed by a machine along a work surface is provided. The controller may include a tracking module configured to monitor one or more of machine parameters associated with the machine and profile parameters associated with the work surface, a detection module configured to detect when one or more predefined trigger conditions suggestive of the need for the ripping pass are met based on the machine parameters and the profile parameters, and a request module configured to generate a ripping pass request if one or more of the trigger conditions are met.

DETAILED DESCRIPTION

Although the following sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term is expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

Figure 1:
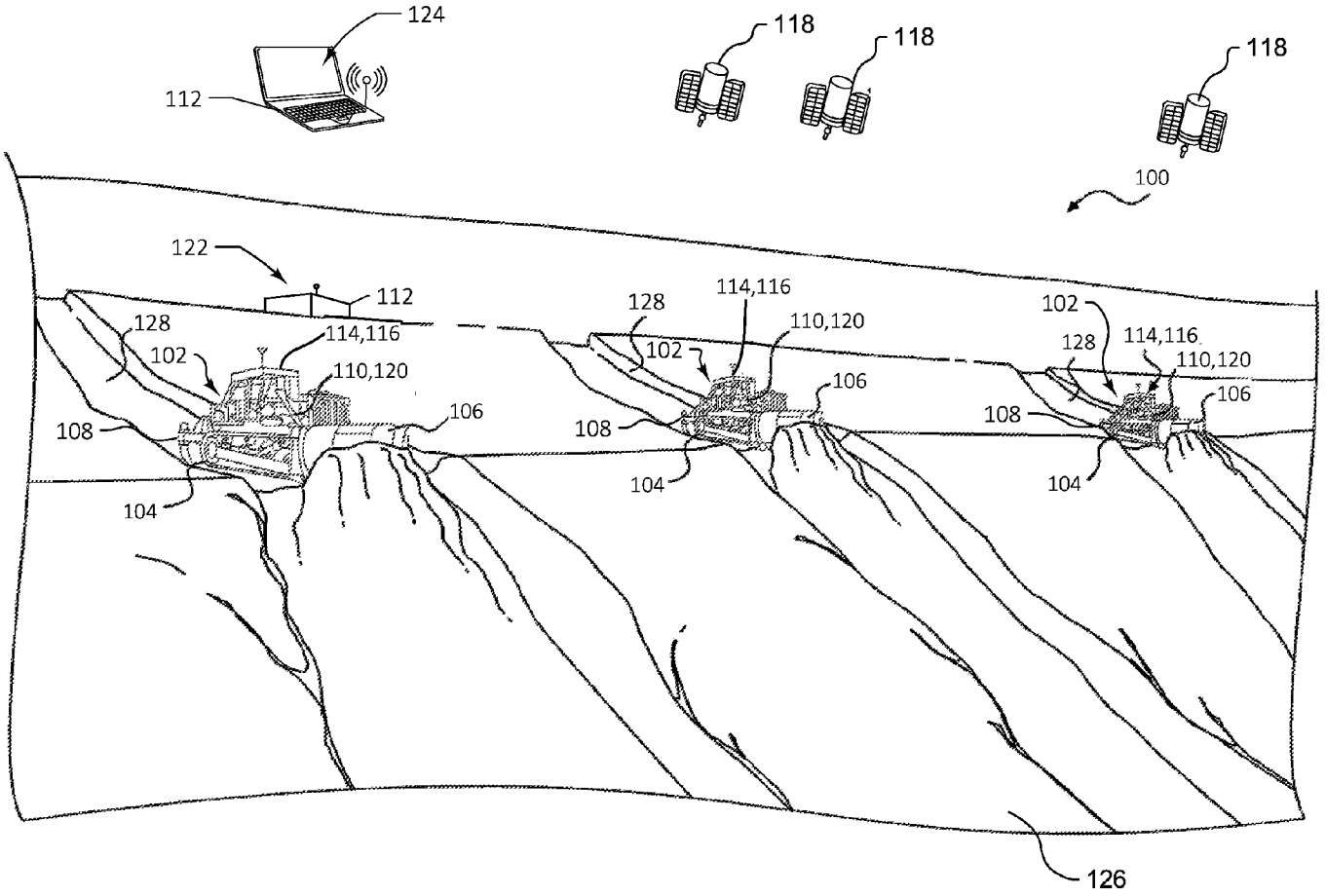
FIG. 1 is a pictorial illustration of an exemplary worksite.

Referring now to FIG. 1, one exemplary worksite 100 is illustrated with one or more machines 102 performing predetermined tasks. The worksite 100 may include, for example, a mine site, a landfill, a quarry, a construction site, or any other type of worksite. The predetermined task may be associated with altering the geography at the worksite 100, such as a dozing operation, a grading operation, a leveling operation, a bulk material removal operation, or any other type of operation that results in geographical modifications within the worksite 100. The machines 102 may be mobile machines configured to perform operations associated with industries related to mining, construction, farming, or any other industry known in the art. The machines 102 depicted in FIG. 1, for example, may embody earth moving machines, such as dozers having traction devices 104 for causing motion, as well as implements, such as blades 106 for cutting terrain and rippers 108 for loosening hard sections of terrain, which may be movable by way of one or more actuators 110. The machines 102 may also include manned machines or any type of autonomous or semi-autonomous machines.

The overall operations of the machines 102 and the machine implements 106, 108 within the worksite 100 may be managed by a control system 112 that is at least partially in communication with the machines 102. Moreover, each of the machines 102 may include any one or more of a variety of feedback devices 114 capable of signaling, tracking, monitoring, or otherwise communicating relevant machine parameters or other information to the control system 112. For example, each machine 102 may include a locating device 116 configured to communicate with one or more satellites 118, which in turn, may communicate to the control system 112 various parameters and information pertaining to the position and/or orientation of the machines 102 relative to the worksite 100. Each machine 102 may additionally include one or more implement sensors 120 configured to track and communicate position and/or orientation information of the implements 106, 108 to the control system 112.

The control system 112 may be implemented in any number of different arrangements. For example, the control system 112 may be at least partially implemented at a command center 122 situated locally and/or remotely relative to the worksite 100 with sufficient means for communicating with the machines 102, for example, via satellites 118, or the like. Additionally or alternatively, the control system 112 may be implemented using one or more computing devices 124 with means for communicating with one or more of the machines 102 or one or more command centers 122 that may be locally and/or remotely situated relative to the worksite 100. In still further alternatives, the control system 112 may be at least partially implemented on-board any one or more of the machines 102 that are also provided within the worksite 100. Other suitable modes of implementing the control system 112 are possible and will be understood by those of ordinary skill in the art.

Using any of the foregoing arrangements, the control system 112 may generally be configured to monitor the positions of the machines 102 and/or machine implements 106, 108 relative to the worksite 100 and a predetermined target operation, and provide instructions for controlling the machines 102 and/or machine implements 106, 108 in an efficient manner in executing the target operation. In certain embodiments, the machines 102 may be configured to excavate areas of a worksite 100 according to one or more predefined excavation plans. The excavation plans may include, among other things, information relating to a location, size, and shape of a plurality of cuts into an intended work surface 126 at the worksite 100 along a plurality of spaced apart locations known as slots 128. The control system 112 may also function as a means for monitoring progress of the excavation. For instance, the control system 112 may oversee gradual changes in the location, size, and shape of the cuts in the work surface 126 within the slots 128 so as to enable identification of any deviations in the progress of the excavation as compared with the planned target operation or profile. While described in connection with slot-based excavation planning, the control system 112 may similarly be employed in conjunction with other types of work surfaces 126.

Figure 2:
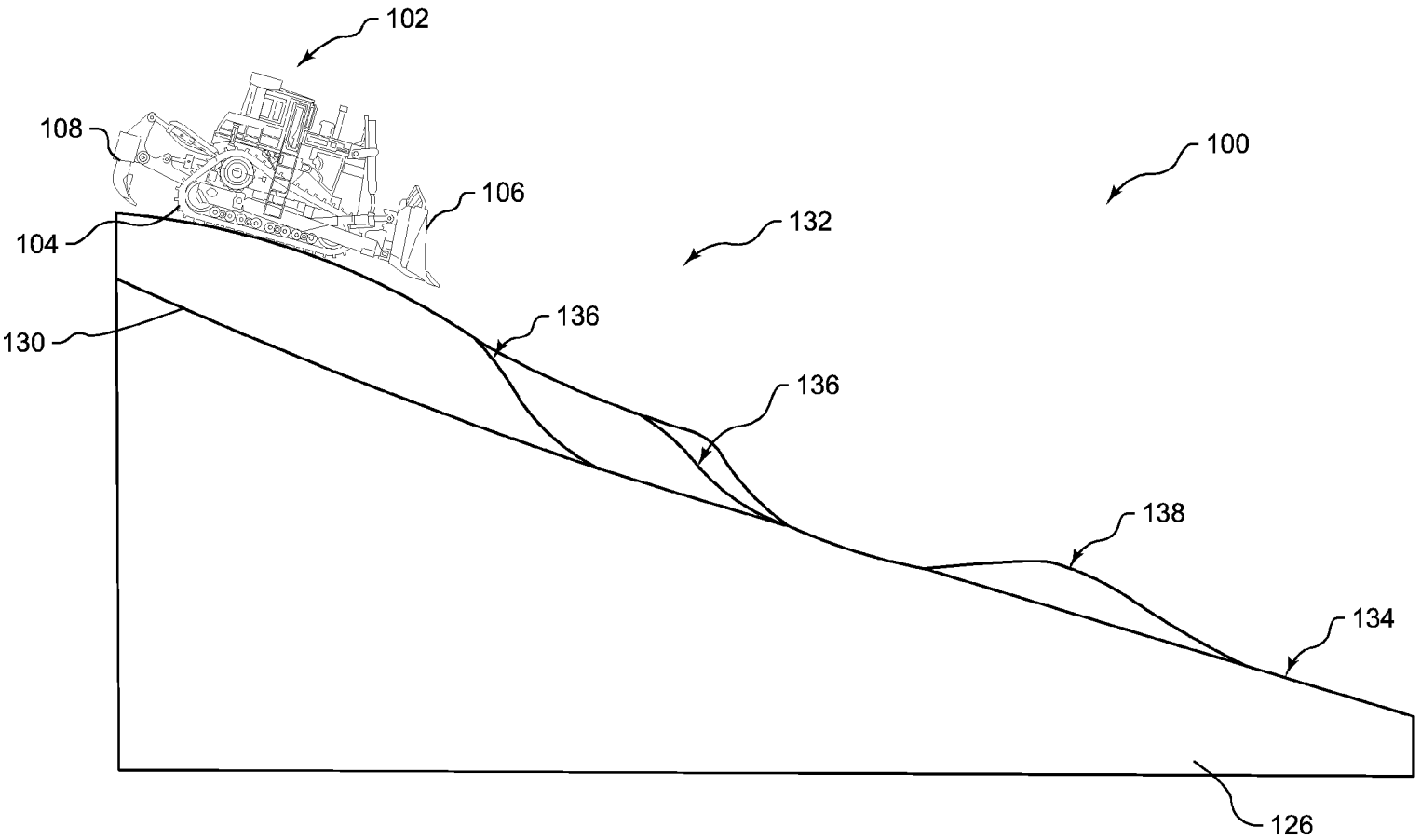
FIG. 2 is a pictorial illustration of a raised surface disposed along one exemplary work surface at a worksite that may be caused by a hard section.

Turning to FIG. 2, one embodiment of a machine 102, such as a dozer having a blade 106 and a ripper 108, is shown as positioned on a work surface 126 of a worksite 100 and configured to perform normal cuts therealong according to a target profile 130. The machine 102 may be configured to begin cutting and loading material at positions proximate to the loading area 132 of the work surface 126, and carry the load toward and along the carry surface 134 for removal. Each normal cut that is performed may be planned to gradually excavate sections of the work surface 126, for example, according to the intermediate cut profiles 136 shown. While performing normal cuts, the machine 102 may encounter hard sections 138 along the work surface 126 which may hinder the ability of the machine 102 to perform a normal cut as planned and leave behind unwanted raised surfaces along the carry surface 134 as shown. Such hard sections 138 may be loosened and/or removed, for instance, by intermittently performing a ripping pass using a ripper implement 108 of the machine 102. Ripping passes may be manually performed by operator control, or semi-autonomously or autonomously performed according to preprogrammed ripping pass routines to reduce operator involvement. To further reduce operator involvement, the control system 112 associated with the machine 102 may also be configured to detect hard sections 138 and automatically identify a need for a ripping pass as disclosed herein.

Figure 3:
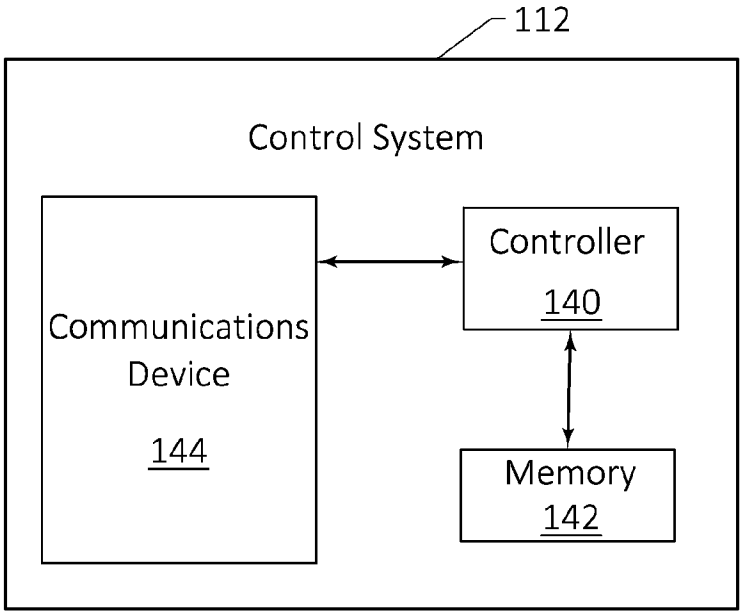
FIG. 3 is a diagrammatic illustration of an exemplary control system that may be used at a worksite to automatically detect ripping pass needs.

With reference to FIG. 3, one exemplary embodiment of such a control system 112 that may be used in conjunction with one or more machines 102 within a worksite 100 to at least automatically detect ripping pass needs is diagrammatically provided. As shown, the control system 112 may generally include, among other things, a controller 140, a memory 142, and a communications device 144. More specifically, the controller 140 may be configured to operate according to one or more algorithms that are retrievably stored within the memory 142. The memory 142 may be provided on-board the controller 140, external to the controller 140, or otherwise in communication therewith. The communications device 144 may be configured to enable the controller 140 to communicate with one or more of the machines 102, and provide parameters or information pertaining to the position and/or orientation of the machines 102 and the machine implements 106, 108, for example, via satellites 118, or any other suitable means of communication. Moreover, the controller 140 may be implemented using any one or more of a processor, a microprocessor, a microcontroller, or any other suitable means for executing instructions stored within the memory 142. Additionally, the memory 142 may include non-transitory computer-readable medium or memory, such as a disc drive, flash drive, optical memory, read-only memory (ROM), or the like.

Figure 4:
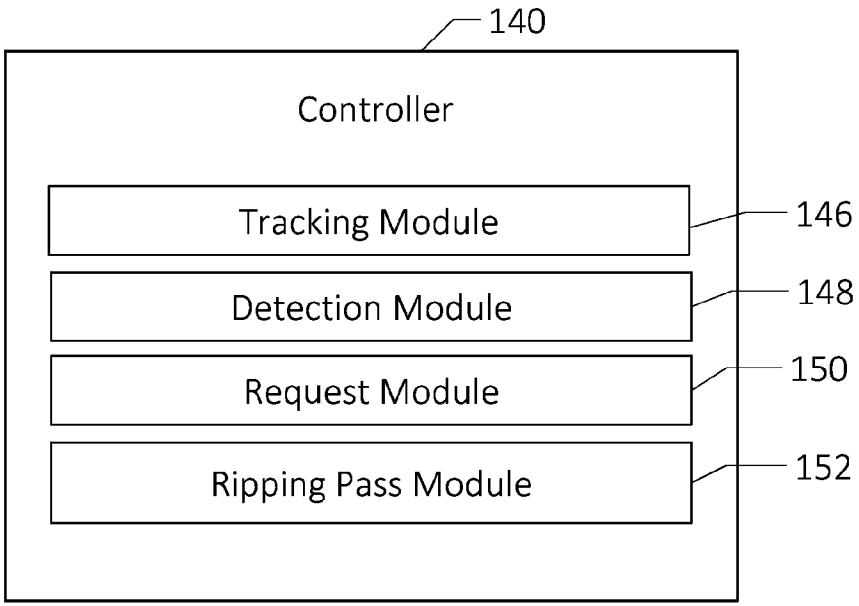
FIG. 4 is a diagrammatic illustration of an exemplary controller that may be used at a worksite to automatically detect ripping pass needs.

Referring to FIG. 4, the controller 140 of the control system 112 may be preprogrammed to detect hard sections 138 and automatically determine a need for a ripping pass according to one or more algorithms, which may generally be categorized into, for example, a tracking module 146, a detection module 148, a request module 150, and a ripping pass module 152. The tracking module 146 may be configured to track the progress of normal cut operations by periodically or continuously monitoring parameters associated with the machine 102 and/or profile parameters associated with the work surface 126. The tracking module 146 may receive the machine and profile parameters from any of the feedback devices 114, locating devices 116, satellites 118, sensors 120, command centers 122, and the like. The tracked machine parameters may include information pertaining to traction, mobility, orientation, position, speed, acceleration, or any other operating parameter of the machine 102. The tracked profile parameters may include information pertaining to the number of normal cuts performed, the relative positions of the normal cuts performed, video feed or sensory data, geometries of the work surface 126 or slots 128 therein, locations of any previously performed ripping passes, or the like. The profile parameters may also include any information derived from grade control pass requirements for the given work surface 126, anticipated productivity indices, preprogrammed decision rules or algorithms, preprogrammed learning algorithms, or any other parameter that may be useful in determining whether a ripping pass is needed.

Based on the machine and profile parameters received and monitored by the tracking module 146, the detection module 148 of FIG. 4 may be configured to detect when any one or more predefined trigger conditions are satisfied, suggesting a need for a ripping pass. Specifically, to determine whether a trigger condition is satisfied, the detection module 148 may assess one or more of the available machine and profile parameters against one or more corresponding predefined thresholds. In one example, a trigger condition may be satisfied if the machine and/or profile parameters indicate that the number of normal cuts already performed exceeds a predefined upper limit or threshold for a given work surface 126, as this may be an indication that a hard section 138 exists and is preventing the machine 102 from making productive cuts and reaching the target profile 130. Along similar lines, a trigger condition may also be satisfied if the machine and/or profile parameters indicate that the current cut position is too close to a previous cut position as determined by predefined distance thresholds. Each of these predefined thresholds may be defined at least partially via operator input and/or via factors relating to the terrain or material type, machine specifications, work surface or worksite specifications, and the like.

Other trigger conditions may be assessed based on video feed data of the work surface 126, which may be captured using cameras provided on-board the machine 102, and used at least partially to identify regions of interest resembling a hard section 138 via image processing or related schemes. For example, regions within the video images exhibiting a consistent shine, contrast or other visual distinctions beyond predefined upper thresholds may suffice to trigger a condition suggesting a need for a ripping pass. Trigger conditions may also be satisfied if the machine and/or profile parameters indicate significant loss of traction between the tracks or traction devices 104 of the machine 102 and the work surface 126. Frequent or prolonged slipping which exceed predefined upper limits or thresholds may suggest that a raised surface or hard section 138 exists along the work surface 126. Similarly, a trigger condition may be satisfied if the machine and/or profile parameters indicate that the machine 102 repeatedly becomes stuck or otherwise hesitates at the same location along the work surface 126 for more than a predefined upper threshold. In addition, the geometries of the work surface 126 and/or the slots 128 as determined via the machine and/or profile parameters may also satisfy a trigger condition, such as when a given slot 128 rolls in excess of a corresponding predefined upper threshold, or when the terrain is relatively inconsistent and contains a number bumps and curvatures which exceed corresponding predefined upper thresholds.

The trigger conditions may also be assessed based on other influences. In one embodiment, a trigger condition may be satisfied if the work surface 126 requires a grade control pass, and if the grade control pass specifies the need for an initial ripping pass to be performed. In other embodiments, the detection module 148 may assess trigger conditions based on preprogrammed decision rules or constraints, as defined by, for example, min-max gaming rules, or the like, to decide whether the combination of machine and profile parameters received at a given instance weighs in favor of or against a need for a ripping pass. Other trigger conditions may be satisfied if productivity assessments or indices calculated for a planned pass or target profile suggest that a ripping pass should improve overall productivity. In still further embodiments, trigger conditions may incorporate one or more learning algorithms which decide in favor of or against a need for a ripping pass based on a given set of machine and/or profile parameters, as well as any behavioral or performance history related thereto. The detection module 148 may similarly assess other trigger conditions, other combinations of trigger conditions, or fewer or more trigger conditions than presented herein. The detection module 148 may also assess trigger conditions based on other predefined thresholds, other combinations of predefined thresholds, or fewer or more predefined thresholds than disclosed above. Furthermore, the sensitivity of the detection module 148, or the predefined thresholds thereof, may be configurable and customized to any given application.

Still referring to FIG. 4, the request module 150 may be configured to generate a ripping pass request if one or more of the trigger conditions are satisfied as determined by the detection module 148. For example, if one or more of the trigger conditions are satisfied, the request module 150 may generate an electronic signal that is communicated to the appropriate machines 102, command centers 122, computing devices 124, or the like, via the communications device 144 to request a ripping pass. Alternatively, if no trigger conditions are satisfied, the request module 150 may communicate a request to perform or continue performing a normal cut according to a preprogrammed target profile 130 or cut profile 136 at least until the next pass or iteration. In addition to the request for the ripping pass, the ripping pass request may also include location information, such as where the ripping pass should begin and/or end relative to the work surface 126. For example, the machine location and/or the location relative to the work surface 126 at which the trigger conditions were satisfied may be flagged as the approximate start location of the ripping pass. In other modifications, the ripping pass request may additionally include information pertaining to the geometry and/or other features of the detected hard section 138 which may aid in performing the ripping pass.

Furthermore, the request module 150 may be configured to request either manual or automatic ripping passes. For instance, the ripping pass requests may invoke notifications that are communicated to one or more of the machine 102, command center 122 and any available computing devices 124 to request operator input and control for a manual ripping pass at the flagged locations. For automatic ripping passes, the ripping pass requests may invoke, for example, the ripping pass module 152 of FIG. 4 to automatically engage the machine 102 to perform the ripping pass at the flagged locations according to predetermined ripping pass routines programmed into the control system 112 thereof. In addition, depending on the desired application, the request module 150 may be configured such that any one of the available trigger conditions is sufficient to generate a ripping pass request, or alternatively configured such that multiple trigger conditions may need to be satisfied in order to generate a ripping pass request. In other embodiments, the request module 150 may also be configured to generate a ripping pass request only when select combinations of trigger conditions are satisfied.

Additionally, any one or more of the functions or tasks of the control system 112, such as the request module 150 and the ripping pass module 152, may be performed as a multi-machine operation, or implemented across two or more machines 102 working in conjunction with one another within a given worksite 100. In particular, locations previously flagged for a ripping pass by one machine 102 may be ultimately executed by another machine 102, which may be selected based on factors expected to improve overall productivity and efficiency, such as relative machine location, anticipated machine path, machine position, machine condition, and the like. Previously generated ripping pass requests may also be fulfilled by other machines 102 in cases where the machine 102 that originally requested the ripping pass was unable to perform the ripping pass due to machine limitations, preprogrammed thresholds, or other restrictions. For example, a machine 102 that detects a need for a ripping pass in a given slot 128 may be unable to execute the ripping pass if it reaches a threshold position or elevation, at which point the machine 102 may be forced or preprogrammed to move onto another slot 128 or otherwise cease work in that slot 128. In such cases, the next machine 102 which enters that slot 128 may be used to perform the ripping pass according to the location previously flagged by the prior machine 102. Multi-machine operations may also be used to further improve the ripping pass detection capabilities or algorithms. For example, the ripping pass needs detected by multiple machines 102 for a given worksite 100 may be collectively monitored for patterns or characteristics which the control system 112 or any learning algorithm preprogrammed therein may use to progressively improve detection accuracy and provide a more intuitive detection algorithm.

Other variations and modifications to the algorithms or methods employed to operate the controllers 140 and/or control systems 112 disclosed herein will be apparent to those of ordinary skill in the art. One exemplary algorithm or method by which the controller 140 may be operated to automatically detect a hard section 138 along a work surface 126 and a corresponding need for a ripping pass is discussed in more detail below.

INDUSTRIAL APPLICABILITY

In general terms, the present disclosure sets forth methods, devices and systems for planned excavations or material moving operations where there are motivations to improve overall productivity and efficiency. Although applicable to any type of machine, the present disclosure may be particularly applicable to autonomously or semi-autonomously controlled dozing machines where the dozing machines are controlled along particular travel routes within a worksite to excavate materials. Moreover, the present disclosure may provide means for enabling automatic and early-detection of hard sections along a work surface which may require a ripping pass to more efficiently achieve the end target profile. By providing more intuitive automatic control systems, inconsistencies in the work surface caused by hard sections are more efficiently and proactively addressed, and the excess time typically spent on manual intervention by operators is substantially reduced.

Figure 5:
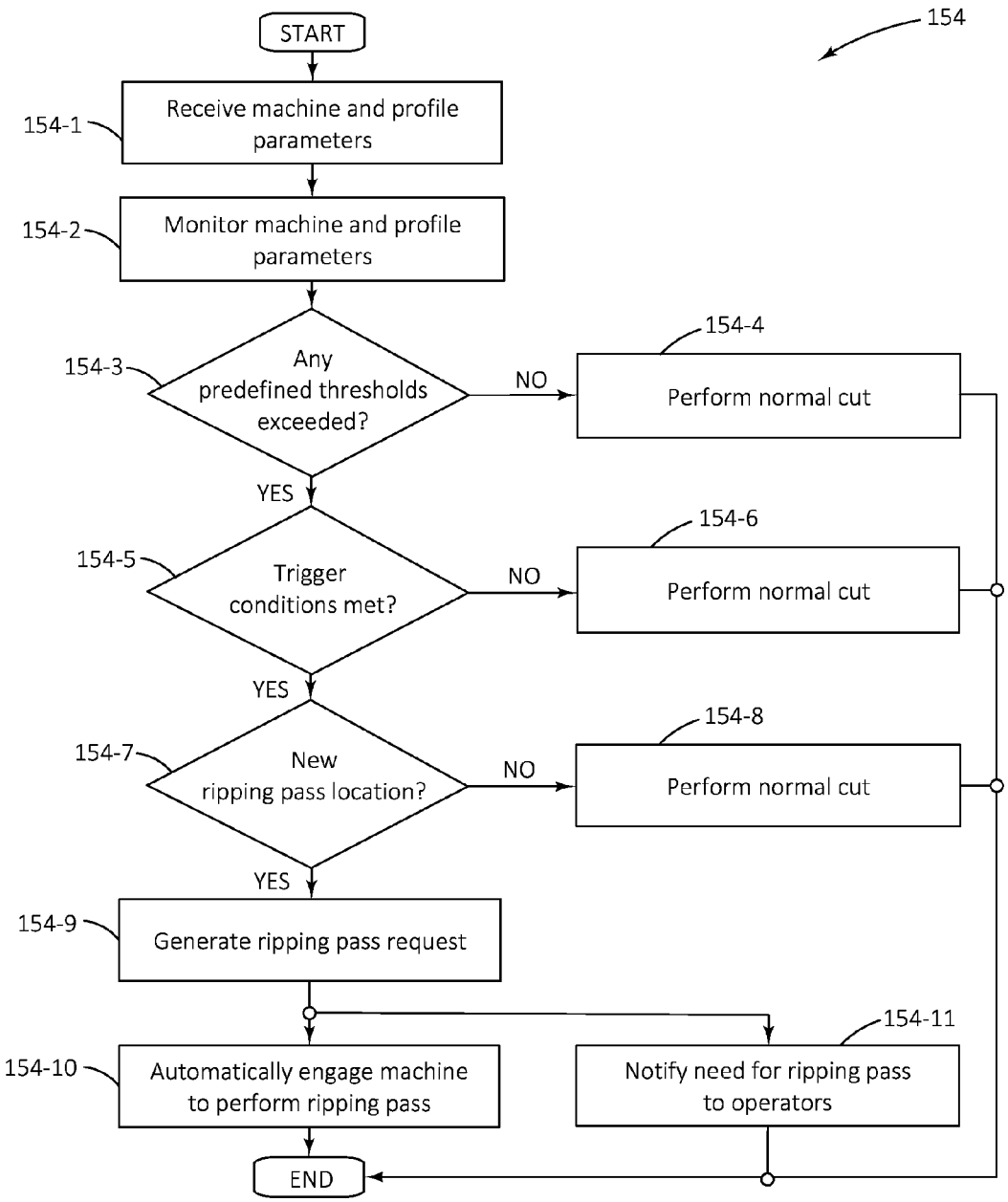
FIG. 5 is a flowchart depicting an exemplary disclosed method that may be performed by a control system of the present disclosure to automatically detect ripping pass needs.

One exemplary algorithm or computer-implemented method 154 for automatically detecting a need for a ripping pass is diagrammatically provided in FIG. 5, according to which, for example, the control system 112 or the controller 140 thereof may be configured to operate. As shown in block 154-1 of FIG. 5, the controller 140 may initially be configured to receive machine parameters associated with the machine 102 and profile parameters associated with the work surface 126, such as provided through the communications device 144 and from any of the feedback devices 114, locating devices 116, satellites 118, sensors 120, command centers 122, and the like. The machine parameters may include information pertaining to traction, mobility, orientation, position, speed, acceleration, or any other operating parameter of the machine 102. The tracked profile parameters may include information pertaining to the number of normal cuts performed, the relative positions of the normal cuts performed, video feed or other sensory data, geometries of the work surface 126 or slots 128 therein, locations of any previously performed ripping passes, or the like. The profile parameters may also include any information derived from grade control pass requirements for the given work surface 126, anticipated productivity indices, preprogrammed decision rules or algorithms, preprogrammed learning algorithms, or any other parameter that may be useful in determining whether a ripping pass is needed.

As shown in block 154-2 of FIG. 5, the controller 140 may additionally monitor the machine and profile parameters periodically or continuously for any inconsistencies in the operation of the machine 102 and/or any inconsistencies in the progress of the normal cut operations or profile of the work surface 126. Based on the information received, the controller 140 in accordance with block 154-3 may compare one or more of the machine and profile parameters to corresponding predefined thresholds in an effort to detect signs of hard sections 138, or raised surfaces and other irregularities in the work surface 126 caused thereby. If no predefined thresholds are exceeded for a given pass or iteration, the controller 140 may conclude that there is no hard section 138 and instruct the machine 102 to perform or to continue performing normal cuts according to a preprogrammed target profile 130 or cut profile 136 in block 154-4. If any one or more of the predefined thresholds is exceeded, the controller 140 in block 154-5 may be configured to determine if the amount of thresholds that are exceeded and/or the type of parameters that exceeded thresholds suffice to satisfy any one or more preprogrammed trigger conditions for suggesting presence of a hard section 138 along the work surface 126. If the events detected during block 154-3 are not sufficient to require a ripping pass, the controller 140 may again conclude that there is no hard section 138 and instruct the machine 102 to perform or to continue performing normal cuts according to a preprogrammed target profile 130 or cut profile 136 in block 154-6.

If, however, the detected events are sufficient to suggest the presence of a hard section 138 in the work surface 126, the controller 140 may proceed to block 154-7 to determine whether a ripping pass was previously performed at the same location. More specifically, the controller 140 may compare the currently flagged location, or the location along the work surface 126 at which the trigger conditions were satisfied, to the locations of any previously performed ripping passes which may have been stored in memory 142. If the currently flagged location is relatively close to a previously performed ripping pass location, the controller 140 may deem that the new ripping pass is unnecessary and perform a normal cut in accordance with block 154-8. If, however, the currently flagged location is relatively distanced from previously performed ripping pass locations, or if no ripping passes have been previously performed for the given work surface 126 or slot 128, the controller 140 may proceed to block 154-9 to generate a ripping pass request. Moreover, the controller 140 may be configured to generate electronic signals and communicate the signals to the appropriate machines 102, command centers 122, computing devices 124, or the like, via the communications device 144 to request a ripping pass. The ripping pass request may also include additional information, such as the location where the ripping pass should begin and end relative to the work surface 126, or information pertaining to the geometry and/or other features of the detected hard section 138 that may be useful in performing the ripping pass.

Once the ripping pass request is generated, the controller 140 in block 154-10 may be configured to automatically engage the machine 102 to perform the ripping pass at the flagged location according to a ripping pass routine that may be preprogrammed into the controller 140 and/or memory 142. In other embodiments, such as where automatic or predetermined ripping pass routines may not be available, the controller 140 as in block 154-11 may be configured to generate notifications that are communicated to one or more of the machine 102, command center 122 and any available computing devices 124 to request operator input and control for a manual ripping pass at the flagged locations. Once the ripping pass is performed, either by automatic or manual execution, the controller 140 may then resume normal cut operations, such as according to instructions provided by preprogrammed target profiles 130 or cut profiles 136. Furthermore, while resuming normal cut operations, the controller 140 may simultaneously and automatically continue to detect hard sections 138 and any further needs for a ripping pass in subsequent passes or iterations.

Figure 6:
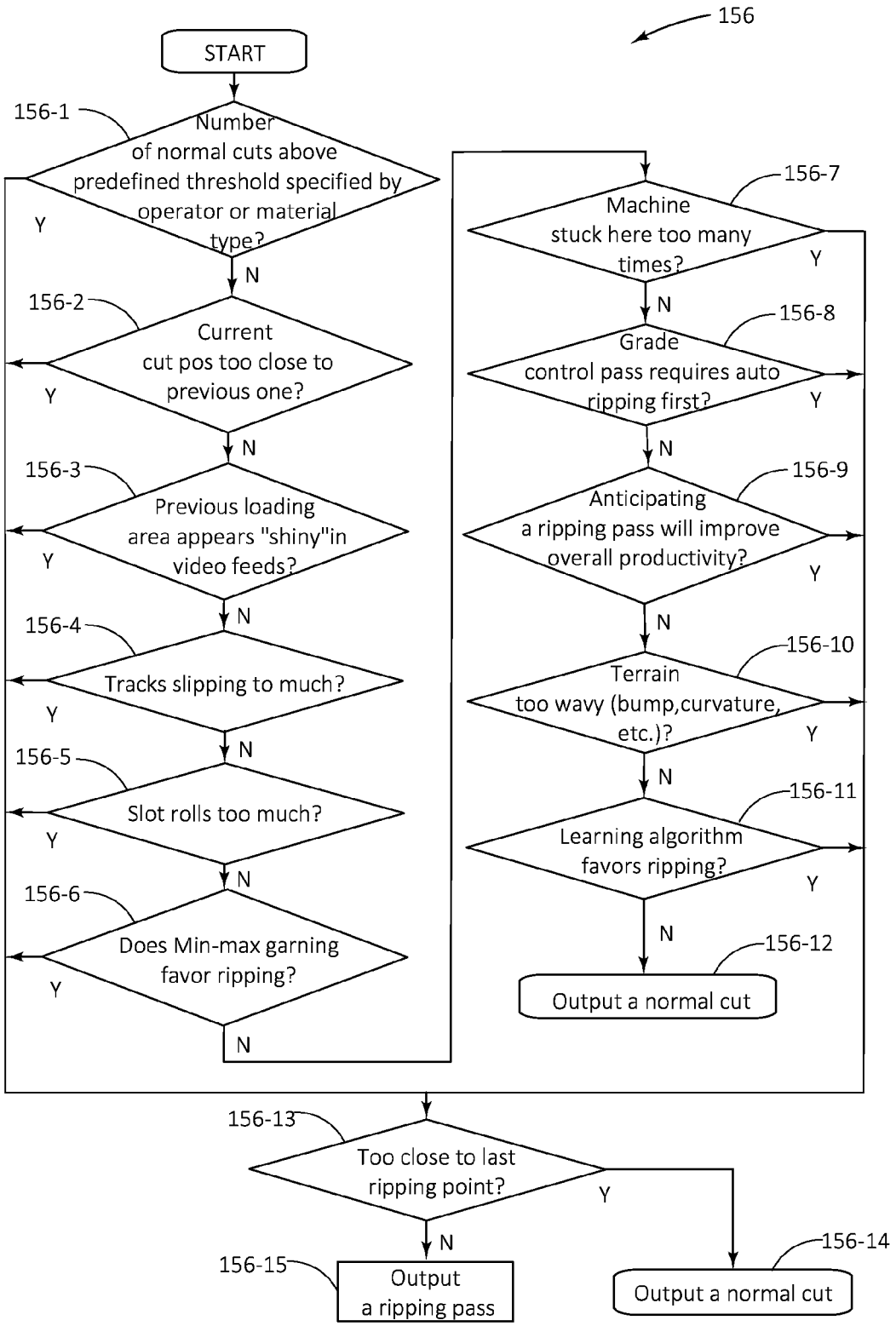
FIG. 6 is a flowchart depicting an exemplary set of trigger conditions that may be used by a control system of the present disclosure to automatically detect ripping pass needs.

Turning now to FIG. 6, another exemplary algorithm or computer-implemented method 156 for automatically detecting a need for a ripping pass is diagrammatically provided. Specifically, the method 156 shown in FIG. 6 provides one possible implementation of the method 154 of FIG. 5, and more particularly, one exemplary set of trigger conditions and corresponding predefined thresholds that may be used to detect for ripping pass needs. As shown in block 156-1, for example, the first trigger condition may be satisfied if the controller 140 determines that the number of normal cuts already performed, as determined by the machine and profile parameters, exceeds a predefined upper count limit or threshold, as specified by operator input and/or other factors relating to the terrain or material type, machine specifications, work surface or worksite specifications, and the like. The second trigger condition of block 156-2 may be satisfied if the controller 140 determines that a current cut position is too close to a previous cut location. In block 156-3, the controller 140 may monitor video feed data for visibly distinct features in the work surface 126 which may be indications of embedded obstacles or other surface irregularities that the machine 102 may have failed to remove over one or more consecutive cuts or passes. Moreover, the third trigger condition of block 156-3 may be satisfied if, for example, the video feed depicts a previous loading area 132 as being shinier or otherwise more contrasted relative to other areas of the work surface 126 or slot 128.

As shown in block 156-4 of FIG. 6, the fourth trigger condition may be satisfied if the controller 140 determines that the machine 102 exhibits an excessive loss of traction, such as in terms of frequency and/or duration, for a given set of passes. The fifth trigger condition in block 156-5 may be satisfied if the controller 140 detects that a given slot 128 exhibits too much roll. For the sixth trigger condition of block 156-6, the controller 140 may apply preprogrammed decision rules, constraints, conditionals, or other algorithms, such as min-max gaming rules, to a given set of machine and/or profile parameters to determine whether a ripping pass routine is recommended. The seventh trigger condition shown in block 156-7 may be satisfied if the controller 140 determines that the machine 102 is consistently getting stuck at the same or substantially the same location along the work surface 126 or slot 128. The eighth trigger condition of block 156-8 may be satisfied if the controller 140 determines a grade control pass is required, and if the grade control pass specifies a need for an initial ripping pass. Additionally, the ninth trigger condition of block 156-9 may be satisfied if the controller 140 determines that a ripping pass would likely improve overall productivity based on a given set of machine and/or profile parameters. According to block 156-10, the tenth trigger condition may be satisfied if the controller 140 finds the terrain or work surface 126 to be too irregular, such as having an excess amount of bumps, curvatures, and the like. Furthermore, the eleventh trigger condition shown in block 156-11 may be satisfied if the controller 140 incorporates learning algorithms, and if the learning algorithms favor a ripping pass.

According to the particular configuration shown in FIG. 6, if none of the trigger conditions is satisfied, the controller 140 in block 156-12 may determine that no hard section 138 exists and resume normal cut operations, for example, according to preprogrammed target profiles 130 or cut profiles 136. If, however, any one of the trigger conditions is satisfied, the controller 140 according to block 156-13 may determine whether the currently flagged ripping pass location is too close to any previously performed ripping pass locations. If the currently flagged ripping pass location is too close to the location of a previously performed ripping pass, the controller 140 in block 156-14 may again resume normal cut operations as planned. However, if no previous ripping passes have been performed for the given work surface 126 or slot 128, or if none of the previous ripping pass locations is close to the currently flagged location, then the controller 140 may proceed to request or engage a ripping pass according to block 156-15.

Furthermore, although the method 156 illustrated in FIG. 6 may suggest that the individual trigger conditions are monitored in succession and in the order shown, it will be understood that any two or more of the trigger conditions shown may be monitored in other sequences and/or monitored simultaneously. Also, while the method 156 shown may suggest that any one of the trigger conditions may invoke a ripping pass to be performed, in other embodiments, combinations of two or more trigger conditions may be required in order to invoke a ripping pass. In still further modifications, the method 156 may incorporate additional trigger conditions, and/or omit one or more of the trigger conditions shown.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. A computer-implemented method for automatically detecting a need for a ripping pass to be performed by a machine along a work surface, comprising:

periodically receiving from the machine one or more machine parameters, and one or more profile parameters of the work surface, with a communication device of a control system;

monitoring with a controller of the control system the machine parameters and profile parameters;

determining with the controller whether one or more predefined trigger conditions suggestive of the need for the ripping pass are met based, at least in part, on the machine parameters and the profile parameters; and generating with the controller, and transmitting to the machine with the communication device, a ripping pass request if one or more of the trigger conditions are satisfied; and wherein the ripping pass request, when received by the machine, causes the machine to perform a ripping pass.

2. The computer-implemented method of claim 1, wherein the machine parameters include assessment of any one or more of loss of traction, machine mobility, machine orientation, machine position, machine speed, and machine operation.

3. The computer-implemented method of claim 1, wherein the profile parameters include assessment of any one or more of a number of normal cuts performed, a position of a current cut relative to a previous cut, video feed data, slot geometry, work surface geometry, prior ripping pass locations, grade control pass requirements, anticipated productivity indices, predetermined decision rules, and predetermined learning algorithms.

4. The computer-implemented method of claim 1, wherein the ripping pass request is an electronic signal which automatically engages the machine to perform the ripping pass according to a predetermined ripping pass routine.

5. The computer-implemented method of claim 1, wherein the machine is engaged to perform a normal cut according to a predetermined target profile if none of the trigger conditions is met or if the machine is located substantially close to a prior ripping pass location.

6. The computer-implemented method of claim 1, further comprising receiving the machine parameters and the profile parameters from the machine through any one or more of feedback devices, locating devices, satellites, sensors, and command centers.

7. The computer-implemented method of claim 1, wherein the ripping pass request includes information on the location of the requested ripping pass.

8. A control system for automatically detecting a need for a ripping pass to be performed by a first machine along a work surface, comprising:

a memory including a tangible computer readable medium, executable computer code, and computer code retrievably storing one or more algorithms; and a controller communicatively connected to the memory to receive the executable code; and a communication device communicatively connected to the controller, and configured to receive one or more machine parameters from one or more machines, and one or more profile parameters from the one or more machines; and configured to send a ripping pass request to the first machine; the one or more machines including the first machine; and wherein the executable computer code when executed by the controller, causes the control system to:

receive with the communication device the machine parameters and the profile parameters;

monitor the machine parameters and profile parameters with the controller;

determine with the controller, using the algorithms, if at least one of the machine parameters and the profile parameters, meet one or more predefined trigger conditions suggestive of the need for the ripping pass, generate with the controller a ripping pass request if at least one of the machine parameters and the profile parameters meet one or more of the trigger conditions; and transmit the ripping pass request to the first machine with the communication device; and wherein the ripping pass request, when received by the first machine, causes the first machine to perform a ripping pass.

9. The control system of claim 8, wherein the machine parameters include assessment of any one or more of loss of traction, machine mobility, machine orientation, machine position, machine speed, and machine operation.

10. The control system of claim 8, wherein the profile parameters include assessment of any one or more of a number of normal cuts performed, a position of a current cut relative to a previous cut, video feed data, slot geometry, work surface geometry, prior ripping pass locations, grade control pass requirements, anticipated productivity indices, predetermined decision rules, and predetermined learning algorithms.

11. The control system of claim 8, wherein the ripping pass request when received by the first machine causes a controller of the first machine to automatically engage the first machine to perform the ripping pass according to a predetermined ripping pass routine in response to the ripping pass request.

12. The control system of claim 8, wherein the executable computer code, when executed by the controller causes the controller to generate a normal cut signal, and the communication device to transmit the normal cut signal to the first machine if none of the trigger conditions are met or if the machine is located substantially close to a prior ripping pass location; and wherein the normal cut signal when received by the first machine causes the first machine to perform a normal cut according to a predetermined target profile.

13. The control system of claim 8, wherein the communications device communicatively connected the controller through one or more of feedback devices, locating devices, satellites, sensors, and command centers, to receive the machine parameters and the profile parameters from the one or more machines.

14. The control system of claim 8, wherein the executable computer code when executed by the controller, causes the communications device to receive the machine parameters and profile parameters from a second machine, the second machine different than the first machine.

15. The control system of claim 8, wherein the ripping pass request includes information on the location of the requested ripping pass.

16. A controller for automatically detecting a need for a ripping pass to be performed by a machine along a work surface, comprising:

a processor; and a memory component including a computer readable storage medium, and computer code stored on the computer readable storage medium; the computer code including a tracking module, a detection module, and a request module; and wherein when the tracking module is executed by the processor, the processor causes the controller to monitor one or more of machine parameters associated with the machine and profile parameters associated with the work surface;

wherein when the detection module is executed by the processor, the processor causes the controller to detect when one or more predefined trigger conditions suggestive of the need for the ripping pass are met based, at least in part, on the machine parameters and the profile parameters; and wherein when the request module is executed by the processor, the processor causes the controller to generate a ripping pass request if one or more of the trigger conditions are met; and wherein the ripping pass request is an electronic signal which when received by the machine causes a user interface of the machine to generate an operator request for at least partial manual engagement of the machine to perform the ripping pass.

17. The controller of claim 16, wherein the tracking module, when executed by the processor causes the controller to receive the machine parameters and the profile parameters from any one or more of feedback devices, locating devices, satellites, sensors, and command centers.

18. The controller of claim 16, wherein the detection module, when executed by the processor causes the controller to assess machine parameters associated with any one or more of loss of traction, machine mobility, machine orientation, machine position, machine speed, and machine operation.

19. The controller of claim 16, wherein the detection module, when executed by the processor causes the controller to assess profile parameters associated with any one or more of a number of normal cuts performed, a position of a current cut relative to a previous cut, video feed data, slot geometry, work surface geometry, prior ripping pass locations, grade control pass requirements, anticipated productivity indices, predetermined decision rules, and predetermined learning algorithms.

20. The controller of claim 16, wherein the ripping pass request includes information on the location of the requested ripping pass.

* * * * *